US010683161B2

(12) United States Patent
Rodrigues

(10) Patent No.: US 10,683,161 B2
(45) Date of Patent: Jun. 16, 2020

(54) APPARATUS FOR COLLECTING AND STORING AUTOGRAPHS

(71) Applicant: Maximiliano Gaston Rodrigues, South Salem, NY (US)

(72) Inventor: Maximiliano Gaston Rodrigues, South Salem, NY (US)

( * ) Notice: Subject to any disclaimer, the term of this patent is extended or adjusted under 35 U.S.C. 154(b) by 59 days.

(21) Appl. No.: 16/011,418

(22) Filed: Jun. 18, 2018

(65) Prior Publication Data

US 2018/0362248 A1 Dec. 20, 2018

Related U.S. Application Data

(62) Division of application No. 14/878,722, filed on Oct. 8, 2015, now abandoned.

(51) Int. Cl.
*B65D 85/00* (2006.01)
*B65D 25/10* (2006.01)

(52) U.S. Cl.
CPC ..... *B65D 85/70* (2013.01); *B65D 25/103* (2013.01)

(58) Field of Classification Search
USPC ..... 206/459.1, 459.5, 457; 40/312
See application file for complete search history.

(56) References Cited

U.S. PATENT DOCUMENTS 3,508,484 A 4/1970 Hickey
3,716,936 A 2/1973 Miller
3,733,726 A 5/1973 Nelson
3,992,811 A 11/1976 Yellin
4,195,729 A 4/1980 Macken
4,427,114 A 1/1984 Howell
4,478,331 A 10/1984 Ruin
5,094,483 A 3/1992 James
5,190,127 A 3/1993 Cummings
5,199,568 A 4/1993 Streit
5,263,576 A 11/1993 Boreen
5,330,053 A 7/1994 Tabuchi
5,448,844 A 9/1995 Miller, Jr.
5,788,082 A 8/1998 Nyseth
7,213,711 B2 5/2007 Wang
7,571,805 B2 8/2009 Cunningham
7,637,047 B1 12/2009 Nielson
D610,350 S 2/2010 Smith
7,905,038 B2 * 3/2011 Coff ..... A47J 41/00 206/459.5
7,987,988 B2 8/2011 Johnson et al.
8,707,526 B2 4/2014 Cooke
9,038,843 B2 * 5/2015 Joy ..... A47J 36/00 220/232
9,108,791 B2 8/2015 Shirkey
D759,981 S 6/2016 Roper
2003/0141217 A1 7/2003 Park
(Continued)

*Primary Examiner* — Jacob K Ackun
(74) *Attorney, Agent, or Firm* — Leason Ellis LLP

(57) ABSTRACT

An apparatus for collecting and storing autographs includes a housing having a hollow interior that is configured to receive and hold autograph media. The housing includes a plurality of side walls and a floor and can be in the form of a cube. The apparatus includes an outer frame that is disposed about an outer surface of one side wall and defines an exterior slot that is open along one side for receiving autograph medium. The autograph medium comprises a substrate that has a surface on which an autograph can be written.

12 Claims, 9 Drawing Sheets

(56) References Cited

U.S. PATENT DOCUMENTS

| | | | | |
|---|---|---|---|---|
| 2005/0006266 | A1 | 1/2005 | Kurikawa | |
| 2006/0236579 | A1* | 10/2006 | Cranman | G09F 3/20 40/654.01 |
| 2010/0140270 | A1 | 6/2010 | Becklin | |
| 2016/0130835 | A1* | 5/2016 | Clay | A47G 1/0622 40/124.5 |
| 2017/0101218 | A1* | 4/2017 | Rodrigues | B65D 25/103 |

* cited by examiner

APPARATUS FOR COLLECTING AND STORING AUTOGRAPHS

CROSS-REFERENCE TO RELATED PATENT APPLICATIONS

This application is a divisional of U.S. Non-Provisional patent application Ser. No. 14/878,722, filed Oct. 8, 2015, the entire contents of which is incorporated by reference herein as if expressly set forth in its respective entirety herein.

TECHNICAL FIELD

The present invention is directed to an apparatus for obtaining and collecting autographs and more specifically, relates to a hollow apparatus that has a plurality of outwardly displayed surfaces for collecting autographs and an interior compartment for storing autographs and other accessories, such as pens, etc.

BACKGROUND

As is well known, an autograph refers to a famous person's artistic signature. This term is used in particular for the practice of collecting autographs of celebrities, such as movie stars, sports stars, politicians and other noteworthy individuals. The hobby of collecting autographs is known as philography.

While autographs can be obtained on any number of different surfaces, such as paper, there are also more elaborate books that can be used to obtain and securely store the autographs. For example, a conventional autograph book has a hard cover and paper pages contained therein. Autographs are written on the paper pages and because of the book construction, the autographs can be safely stored. In addition, it is also common for a person to autograph a photograph. Conventionally, autographed photographs are mounted in a picture frame. While an autograph book is suitable for obtaining multiple autographs at one event, it can be cumbersome to do so since it requires the person to open to a particular page and pass the opened book to the autograph giver and then repeat the process using a new page for the next autograph giver. There is therefore a need for an alternative device and method for obtaining multiple autographs and for storing the obtained autographs safely.

SUMMARY

An apparatus for collecting and storing autographs includes a housing (casing) having a hollow interior that is configured to receive and hold autograph media. The housing includes a plurality of side walls and a floor and can be in the form of a cube. The apparatus includes an outer frame that is disposed about an outer surface of one side wall and defines an exterior slot that is open along one side (e.g., top side) for receiving autograph medium. The autograph medium comprises a substrate, such as an autograph tile, that has a surface on which an autograph can be written. Inside the hollow interior, dividers can be provided for defining individual slots in which individual autograph medium are received and preferably, kept separate from one another.

The substrate includes an outer layer on which an autograph can be written and the outer layer can comprise an outer structure attached to the substrate. The outer structure can emulate a sports ball surface in that the outer structure can be selected from the group consisting of tennis ball felt, football cowhide, baseball cowhide, and basketball cowhide. In this manner, the appearance of the apparatus can be created and tailored in view of an event at which autographs are to be obtained. For example, if the event is a tennis event, the substrate can be in the form of a wooden tile with a yellow felt front layer on which the autograph is written.

Other features of the apparatus are described herein.

BRIEF DESCRIPTION OF THE DRAWING FIGURES

DETAILED DESCRIPTION OF CERTAIN EMBODIMENTS

Figure 1A:
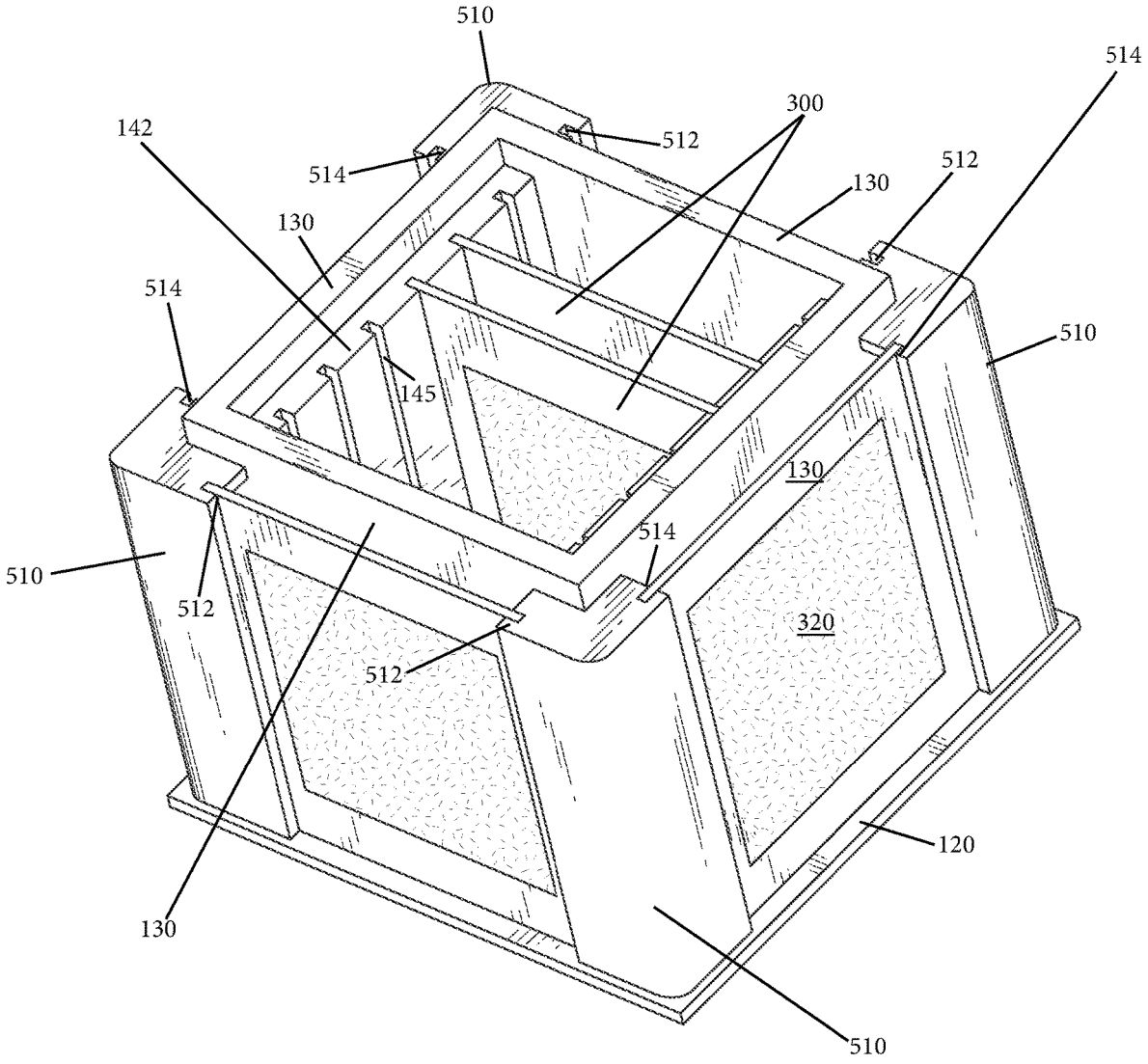
FIG. 1A is a perspective view of an apparatus for collecting and storing autographs in accordance with one embodiment of the present invention.

FIGS. 1A-3 illustrate an apparatus 100 for collecting and storing autographs. As described herein, the apparatus 100 is configured such that a plurality of autographs can be obtained in succession without altering the physical state of the apparatus 100.

In the illustrated embodiment, the apparatus 100 is in the form of a case or housing 110 that has a hollow interior 112 and has a plurality of outwardly facing surfaces which can be used to collect autographs as described herein. In particular the case (housing) 110 has a floor (wall) 120 and a plurality of side walls 130 that are connected along the bottom edges to the floor 120 to define the hollow interior 112. In one embodiment, the case 110 has a square shape and is defined by four side walls 130; however, it will be appreciated that the case 110 can have other shapes and is not limited to a square shape. For example, the case 110 can have a rectangular shape, a triangular shape, polygonal shape, etc. The hollow interior 112 can be accessed through an open top of the case 110.

As shown in the figures, the hollow interior 112 can be divided into two or more spaces or compartments. For example, the illustrated case 110, shown in FIGS. 2 and 3, generally includes a first space or compartment 140 that is configured to store autographs and a second space or compartment 150 that is configured to hold one or more accessories 200, such as writing implements (e.g., pens used to create the autograph). As shown, the first space 140 can include a plurality of dividers 142 that are spaced apart from one another to receive and separate a plurality of autographs. The dividers 142 are configured to define individual slots 145 that receive and arrange the autographs such that they are held in a side-by-side parallel manner. The dividers 142 can be arranged into a first divider 142 that is disposed along one side wall 130 and a second divider 142 that is disposed along another side wall 130 that is opposite the one side wall 130. The dividers 142 can be in the form of a longitudinal rail that includes spaced notches formed therein to define the slots 145. Alternatively, small blocks or tabs (protrusions) can be provided and affixed to the respective side wall 130 with one slot being defined between adjacent tabs and configured to receive one autograph. It will be appreciated that the tabs can be grouped into a first set and a second set with the tabs of the first set being located directly opposite corresponding tabs of the second set so as to define pairs of tabs which define the slots 145 that are configured to receive the autographs.

It will also be appreciated that the locations of the dividers 142 along the respective side walls 130 can vary so long as the dividers 142 effectively define receiving slots 145 for the autographs and sufficiently separate and hold the autographs in place. Similarly, the shapes and sizes of the dividers 142 can vary so long as the dividers 142 serve to separate and hold the autographs in place. Accordingly, the dividers 142 can be in the form of protrusions (e.g., tabs) that are formed along the respective side walls. In addition, it will be appreciated that each slot 145 can be designed to receive more than one autograph.

While the hollow interior 112 is designed to hold and store clean (fresh) medium to place an autograph on and/or autographs that have already been obtained, the apparatus 100 also includes an autograph display and collecting feature to allow one to easily collect multiple autographs at a single time. In particular, the housing 110 includes at least one and preferably includes a plurality (e.g., 4) of exterior autograph collecting slots 250. More specifically, along one or more of the side walls 130, one exterior slot 250 can be provided. As will be described herein, the exterior slot 250 is configured to allow autograph medium to be inserted therein and be securely held and displayed therein. When the autograph medium is inserted into the exterior slot 250, a significant area of the medium is displayed and is freely accessible to allow a person to sign the autograph medium.

The exterior slot 250 can be defined by an exterior frame assembly 500 that defines the slot 250. As shown in FIGS. 1A-3, the frame assembly 500 includes at least one pair and preferably a plurality of pairs of corner frame pieces 510 that are disposed at two or more corners of the housing 110. As shown in FIG. 1A, the corner frame pieces 510 extend along a length of one corner of the housing 110 and thus, the corner frame piece 510 can be thought of as being a rail structure that is oriented vertically along the corner of the housing 110. As shown in the figures (e.g., FIG. 2), the corner frame piece 510 can have an L-shape defined by a first leg 517 that extends along one wall of the housing 110 and a second leg 519 that extends along another wall of the housing 110. Each corner frame piece 510 has a first notch 512 that is disposed along one side wall 130 and a second notch 514 that is disposed along another side wall 130 that is formed at a right angle to the one side wall 130. The corner frame piece 510 can generally be in the form of an L-shaped piece. Two notches 512 of two corner frame pieces 510 face one another and define one exterior slot 250 (when more than two pieces 510 are used, two notches 512 define one slot and two notches 514 define another slot). A floor 530 is disposed between the two corner pieces 510 at the bottoms thereof to define a support surface for the autograph medium. A bottom edge of the autograph rests on the floor 530 with side edges of the autograph medium being contained within the two notches 512 that face one another along the one side wall 130.

It will be understood that the one side wall 130 defines the rear of the exterior slot 250. The corner frame piece 510 can be attached to the side walls 130 using any number of techniques including the use of fasteners (nails, screws, etc.) or the use of bonding agents, such as adhesives, etc. In addition, the floors 120, 530 can the same structure in that floor 120 can have a greater footprint than a maximum width defined between two opposing side walls 130 and therefore, outer peripheral portion of the floor 120 that extends beyond the respective side walls 130 defines the floor 530.

Figure 1B:
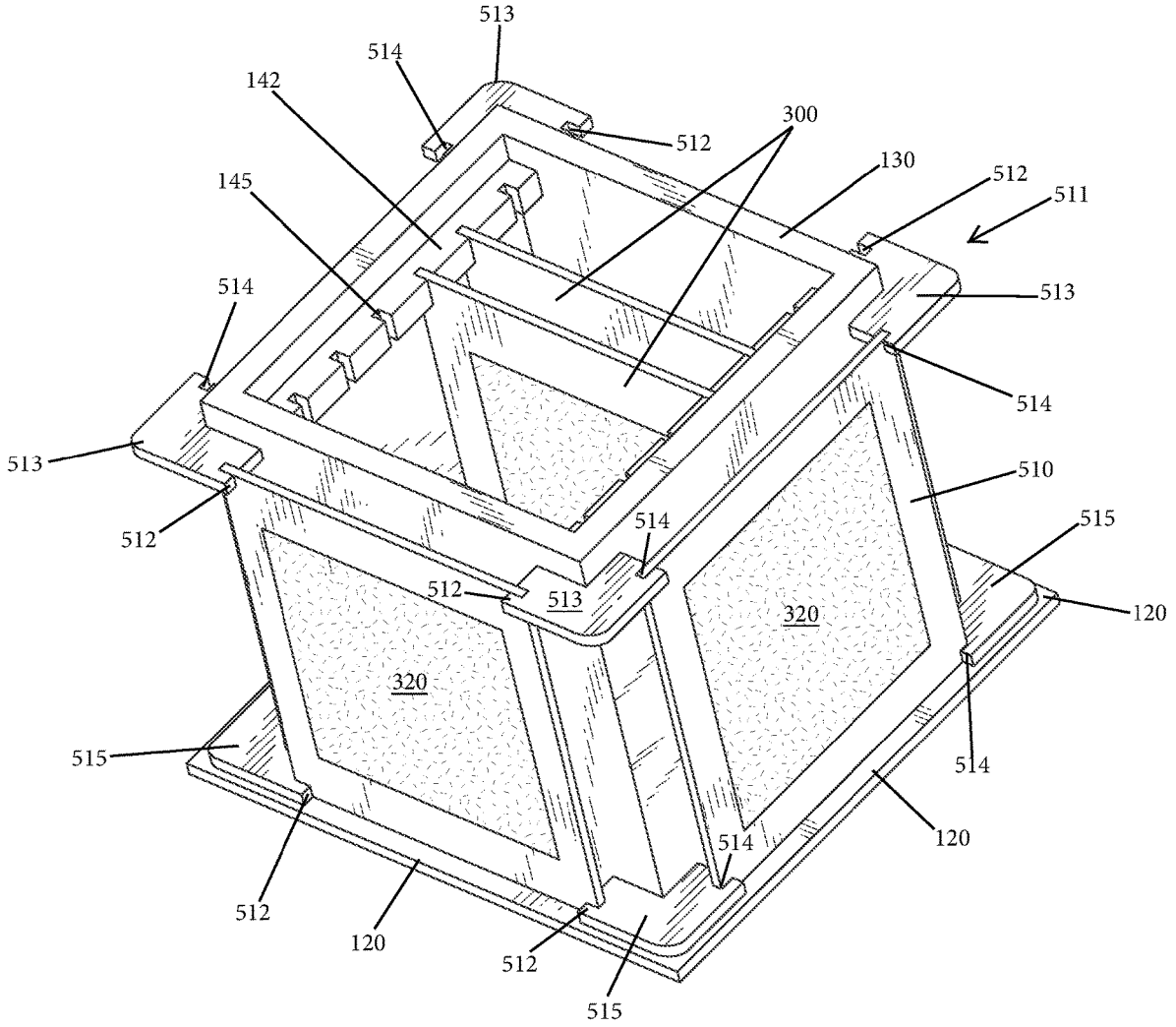
FIG. 1B is a perspective view of an apparatus for collecting and storing autographs in accordance with one embodiment of the present invention.
Figure 2:
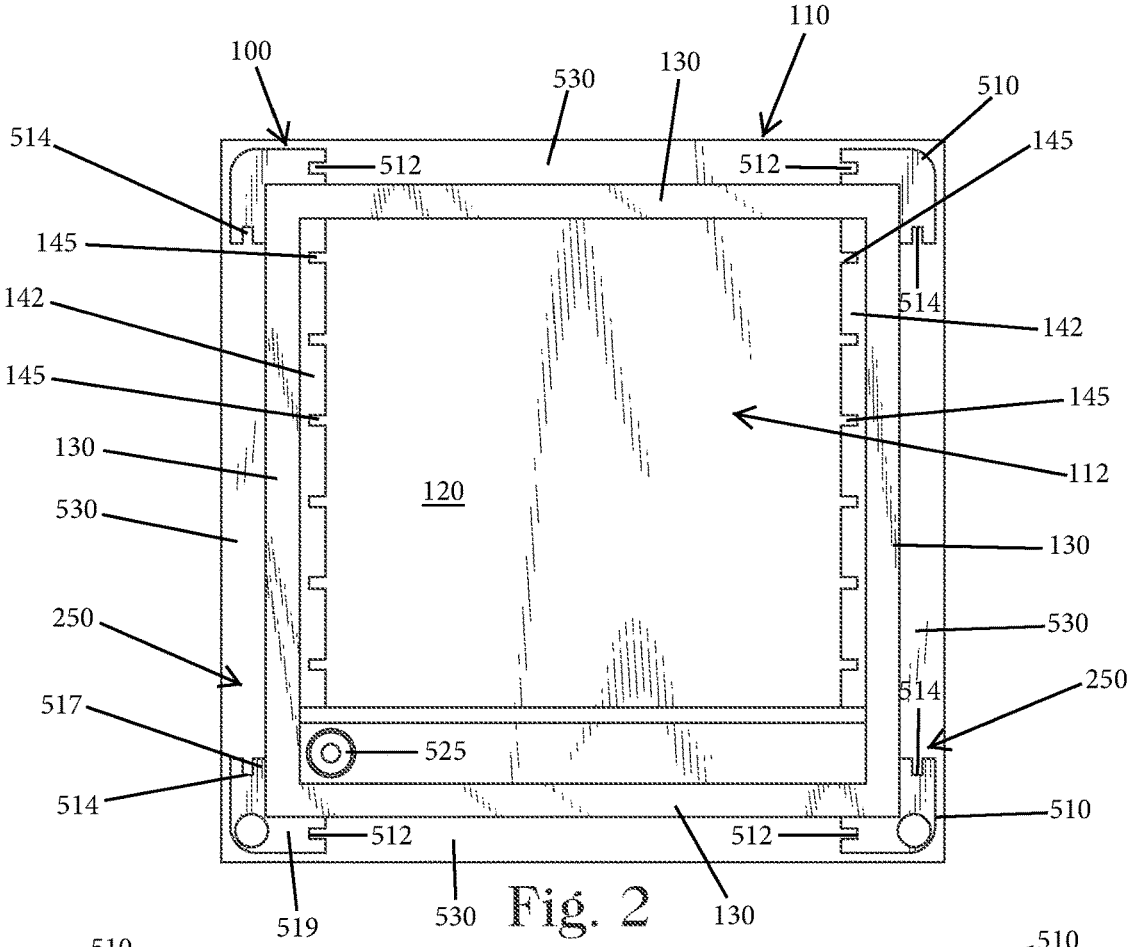
FIG. 2 is a top plan view of the apparatus of FIG. 1A.

In the illustrated embodiment shown in FIGS. 1A-2, there are four corner frame pieces 510 disposed in the four corners of the housing 110, whereby four exterior slots 250 are defined along the four sides walls 130. In this way, the four exterior slots 250 permit at least four autograph media to be inserted into the slots 250 and outwardly displayed. The outward display of the autograph medium allows for a person to easily sign the exposed surface thereof as discussed herein and illustrated in FIGS. 1A and 1B.

It will be appreciated that the frame structure can be configured such that one or more autograph media can be displayed along one or more corresponding sides of the housing 110. Accordingly, while the housing (cube) in FIGS. 1A and B has two autograph media held and displayed along the four sides of the housing 110, it can contain less than four and can contain as few as one.

It will also be appreciated that the notches 512, 514 can be formed completely through the corner frame piece 510 as shown or the notches 512, 514 can terminate prior to one end of the corner frame piece 510, thereby defining a stop. Thus, when the autograph medium is inserted into such notches that define the exterior slot 250, the autograph medium can travel within the notches 512, 514 until the autograph medium reaches the stops at which time the autograph medium can no longer travel and is held securely within the exterior slot 250.

FIG. 1B shows an alternative corner frame piece 511 that instead of being a single structure is divided into two pieces, namely, an upper corner piece 513 and a lower corner piece 515 that is disposed below the upper corner piece 513. Each of the upper corner piece 513 and lower corner piece 515 includes first notch 512 and second notch 514 for receiving the autograph medium as described above.

The apparatus 100 thus includes discrete elements 300 on which an autograph can be written. These discrete elements 300 are configured to be both displayed (held) along the outer surface of the housing 110 and stored in the hollow interior 112 in the slots 145 formed in the dividers 142. In other words, the shape and size of the elements 300 are selected to allow the elements 300 to be held and displayed along outer surfaces of the housing 110 and allow for secure storage of the elements 300 within the hollow interior 112.

The discrete elements 300 include an outwardly facing surface 302 on which the autograph can be written. At least the outwardly facing surface 302 is formed of a material that is conducive to receiving an autograph in a permanent manner. In other words, the material that comprises the outwardly facing surface 302 is selected such that a person can use a writing implement (e.g., pen) to easily and clearly write his/her autograph in such a way that the autograph is permanent in nature. In other words, the autograph does not easily mar and erase from this surface 302 once any initial setting time passes.

Figure 9:
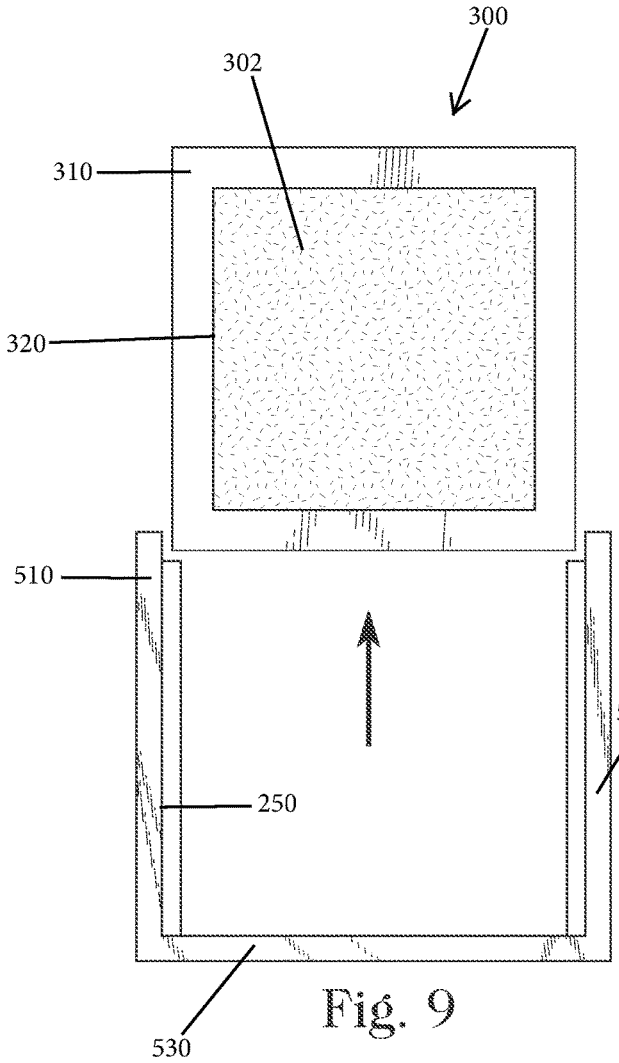
FIGS. 9-11 illustrate a manner of reversing the position of an autograph tile to move between a displayed position and a concealed position.

In one exemplary embodiment, as illustrated in the figures, the discrete elements 300 can be in the form of a plurality of autograph tiles 300. In one embodiment, the discrete element (autograph tile) 300 is formed of two or more layers (which can be formed of two or more materials). In particular, as shown in FIGS. 1A-B and 9, the discrete element 300 can be formed of a rear substrate 310 and a front structure 320 on which the autograph is written. As shown, the front structure 320 can occupy less area than the rear substrate 310 to which it is coupled.

While in the illustrated embodiment, the front structure 320 is illustrated as having the same or similar shape (e.g., square) as the rear substrate 310, it will be appreciated that the two structures can have different shapes. For example, the rear substrate 310 can have a square shape, while the front structure 320 can have a circular shape. Other different shapes for each of the substrate 310 and structure 320 are equally possible.

Figure 12:
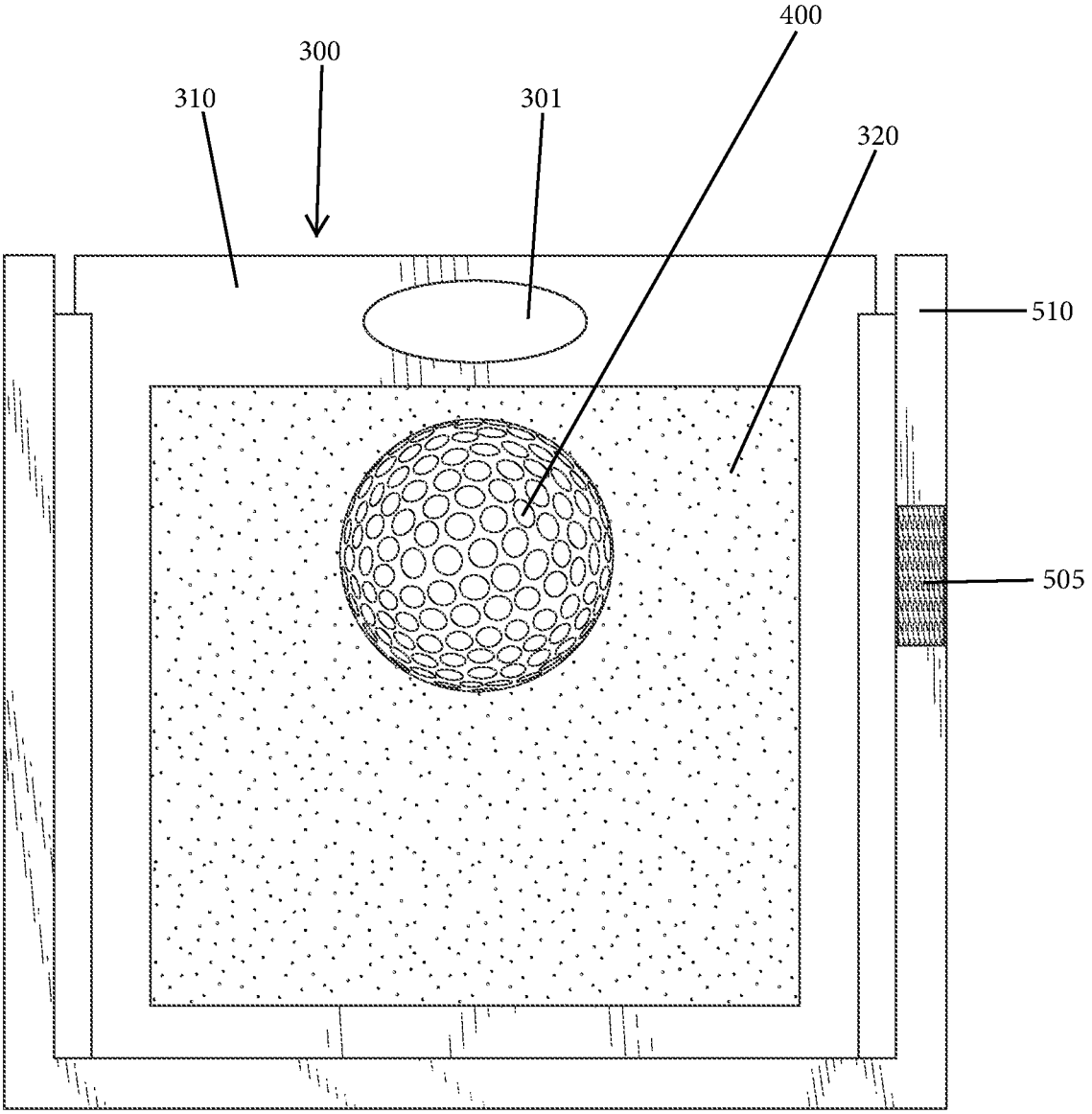
FIG. 12 is a front elevation view of one autograph tile showing decorative indicia.

Also as shown in FIG. 12, the front structure 320 can also include one or more decorative features, e.g., decorative indicia 400. The decorative indicia 400 can be formed on the front structure 320 using any number of suitable techniques including but not limited to printing techniques. The decorative indicia 400 can be of type that falls within the theme of the event at which autographs are being sought or they can be not directly related to the event but instead merely be ornamental in nature. For example, for sports related themes, the decorative indicia 400 can be in the form of a symbol associated with the sport (e.g., a picture of a tennis ball, golf ball, football, baseball, race car, etc.) or the decorative indicia 400 can be in the form of a team logo, etc. The size and location of the decorative indicia 400 on the front structure 320 can vary. The decorative indicia 400 can also depict other themes such as those associated with themes parks, e.g., princess, a castle, etc. However, in any event, the decorative indicia 400 leaves sufficient room for the autograph to be written across the front structure 320.

In one embodiment, the front structure 320 can be formed of a material that has a theme that relates to an event being attended and/or to the individual writing the autograph. For example, if the apparatus 100 is taken to a tennis tournament and the objective is to receive autographs of tennis stars, the front structure 320 can be formed the same material or a material that emulates the material used to make tennis balls. For example, modern tennis balls are formed of a pressurized rubber core and a felt covering. The front structure 320 can thus include or be entirely formed as a felt covering that faces outwardly and is freely accessible to the tennis player from which the autograph is sought. Thus, a layer of tennis ball felt covering can be adhered to a forward (front) face of the rear substrate 310 to provide a tennis ball look and feel and further allows for an autograph to be applied thereto (e.g., as by a tennis star).

A surface area of the felt covering 320 can be different that a surface area of the rear substrate 310 and more particularly, the surface area of the felt covering 320 can be less than the surface area of the rear substrate 310.

It will be appreciated that the material used to form the front structure 320 can vary and in the case of sporting events, the material can be selected in view of a material that is commonly used in a particular sport. For example, for football, the front structure 320 can be formed of leather (cowhide) and for baseball, similarly (cowhide). Paper based materials can also be used as the front structure 320.

It will also be appreciated that the front structure 320 and the rear substrate 310 can be combined into a single structure and in which case, the autograph is written across one surface of such single structure.

In addition, the front structure 320 can be formed of two or more layers and in the case of a tennis ball, a rubber backing layer can be adhered to the rear substrate 310 along with an outer tennis felt layer as discussed above.

In addition, FIG. 12 shows an opening 301 formed in the autograph tile 300 to allow the tile 300 to be easily grasped and inserted or removed from a corresponding receiving slot formed in the apparatus, such as the ones described herein.

Figure 10:
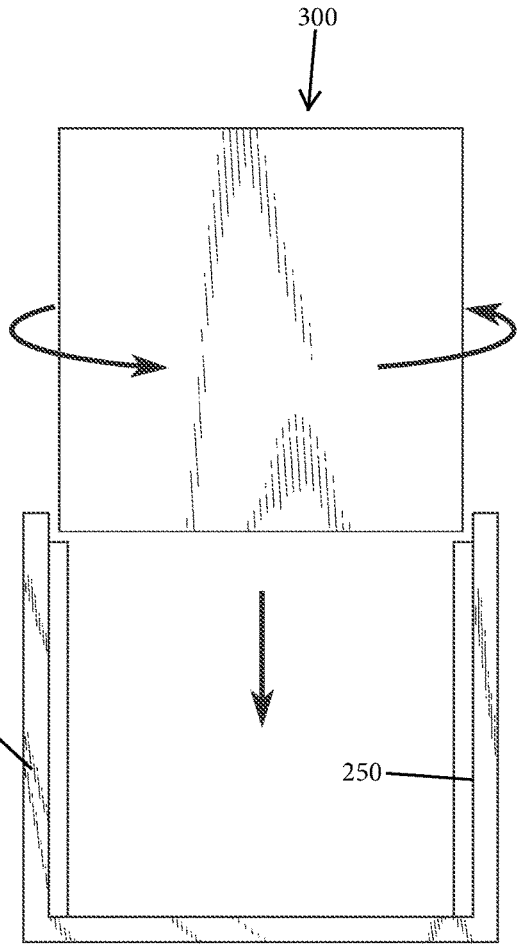
Figure 11:
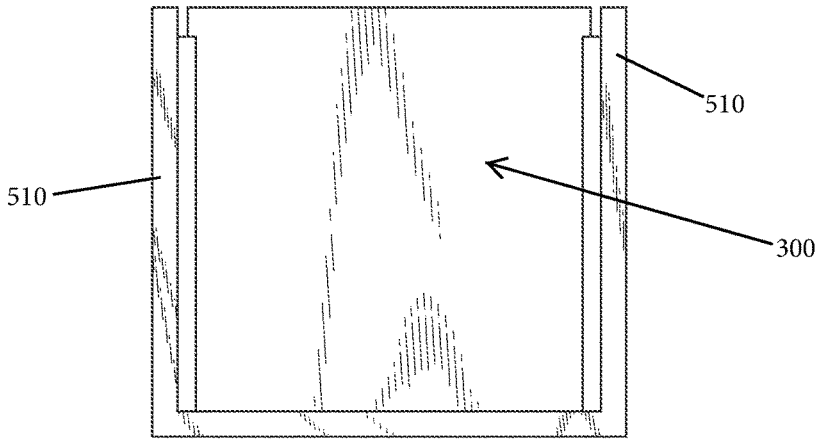

FIGS. 9-11 show another aspect of the apparatus 100 in that the autograph tile 300 can be reversed to protect the autograph. FIG. 9 shows removal of the autograph tile 300 from the exterior slot 250 and then, as shown in FIG. 10, the autograph tile 300 is flipped around and reinserted into the exterior slot 250 to its rest, display position shown in FIG. 11. The flipping of the tile 300 results in the autograph facing inward and thus being protected.

The apparatus 100 can also include a cover 600 that is designed to cover the hollow interior 112 for purpose of protecting the autograph tiles (elements/media) 300 contained therein. The cover 600 is preferably of a type that has a handle or the like to allow the user to easily grasp the cover 600 and also a locking mechanism 650 that causes the cover 600 to be securely, yet releasably, coupled to the apparatus 100.

Figure 4:
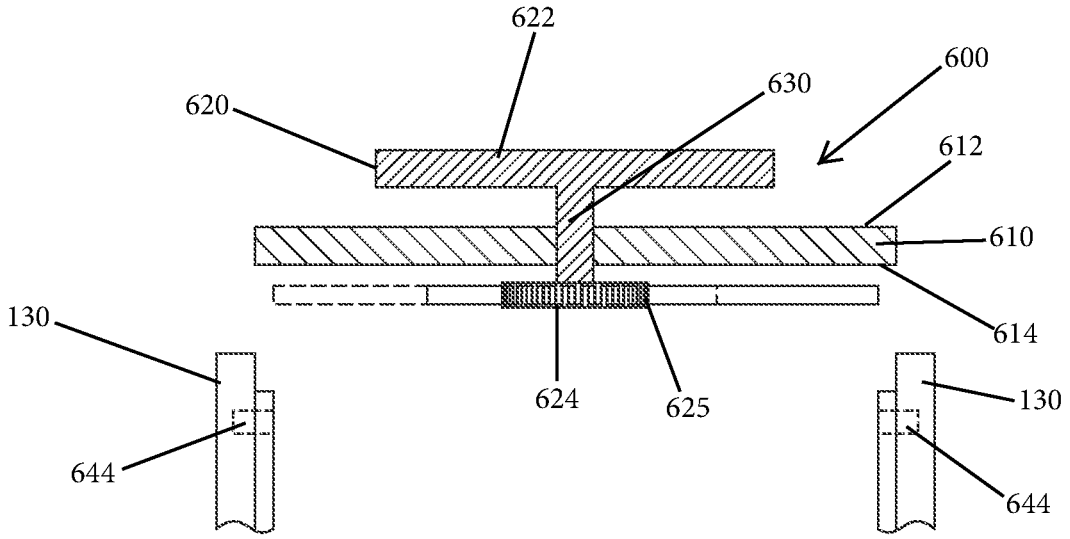
FIG. 4 is partial cross-sectional view of a cover and a first locking mechanism for the apparatus.
Figure 5:
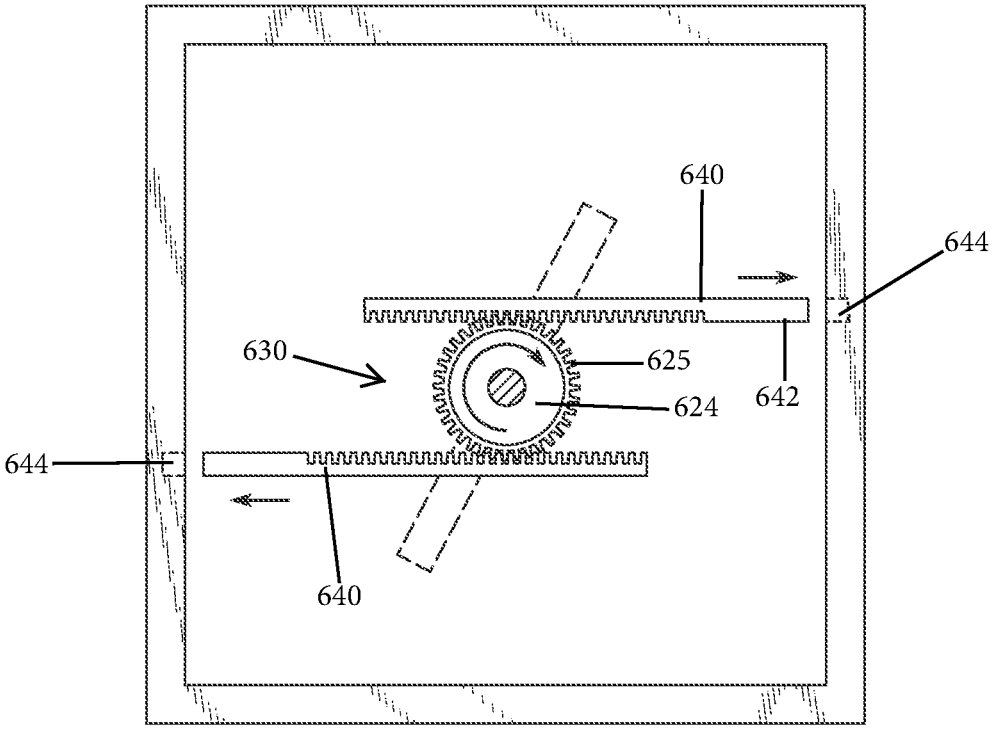
FIG. 5 is a cross-sectional and bottom view of the cover of FIG. 4.

FIGS. 4-5 illustrate cover 600 according to one embodiment with a first locking mechanism 610. The cover 600 has a base portion 610 that has an upper surface 612 and a bottom surface 614. The cover 600 has a handle 620 that is movable to cause the cover 600 to move between an unlocked position and a locked position. The illustrated handle 620 has a top portion 622 that is accessible to the user and intended to be grasped by the user. The handle 620 also includes a bottom portion 624 that is disposed below the bottom surface 614 with a connector portion 630 that connects the top and bottom portions 622, 624. In the illustrated embodiment, the handle 620 is configured to rotate between the unlocked and locked positions. The bottom portion 624 can be in the form of a gear or the like with teeth 625. A locking mechanism 630 includes at least one and preferably two or more locking pins (racks) 640 that each has a first end 642 configured to be received within a locking notch or opening 644 formed in the side wall 130 for locking the cover 600 to the housing 110.

In the illustrated embodiment, there is a pair of locking pins 640 disposed parallel to one another one opposite sides of the gear 624. Rotation of the gear 624 in a first direction causes the two locking pins 640 to be driven in an outward direction toward the respective side walls 130 resulting in the ends 642 of each being received in the respective opening 644.

As shown in FIG. 5, the two locking pins 640 move in opposite directions when the gear 624 rotates in a first direction. By inserting the ends 642 of the two pins 640 into openings 644 formed in opposing side walls 130 of the housing 110, the cover 600 is securely attached to the two side walls 130 and thus, is securely attached to the housing 110 itself.

To reverse and unlock the cover 600 to the housing 110, the user simply rotates the handle 620 in the opposite direction which causes the pins 640 to move in the opposite linear directions resulting in the ends 642 of the pins 640 retracting from the openings 644. The retraction of the pins 640 from the openings 644 allows for free removal of the cover 600 from the housing 110.

While not shown, the locking pins 640 can be disposed within guide channels formed as part of the cover 600. The guide channels are open along two sides of the cover 600 to allow the extension of the pins 640 beyond the perimeter of the cover 600 into the openings 644. The gear 624 is thus in close proximity to the guide channels to allow the gear 624 to be operatively coupled to the two pins 640 within the two guide channels.

Figure 6:
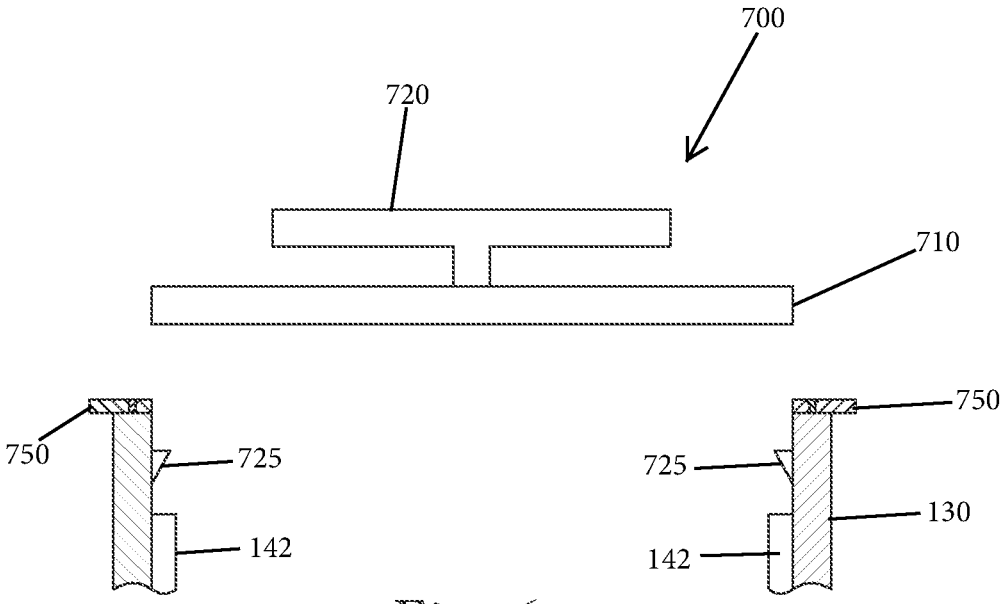
FIG. 6 is partial cross-sectional view of a cover and a second locking mechanism for the apparatus.
Figure 7:
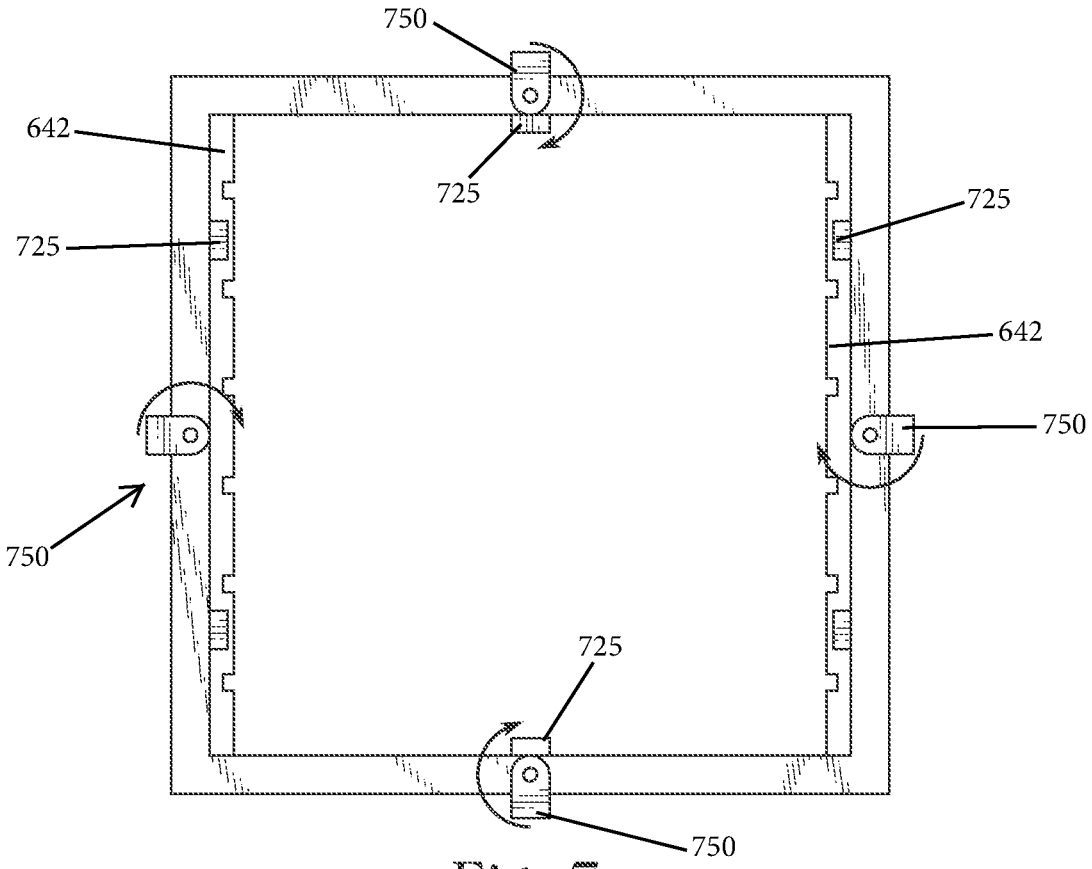
FIG. 7 is a top view of the cover of FIG. 6.

FIGS. 6-7 illustrate a cover 700 according to yet another embodiment. The cover 700 includes a second locking mechanism 750. The cover 700 includes a base portion 710 and a handle 720 that protrudes outwardly therefrom. Unlike the previous embodiment, the handle 720 is fixed in nature and does not move. Along a pair of opposing walls 130, there is a plurality of support tabs 725 spaced about the walls 130 (e.g., proximate the four corners of the housing 110). The tabs 725 have planar (flat) top surfaces to support the base portion 710 of the cover 700. The tabs 725 are formed and located such that they do not interfere with slots 250 that receive the tiles 300.

In this configuration, the base portion 710 is shaped and sized to be received between the four side walls 130 of the housing 110. The thickness of the base portion 710 is selected and the tabs 725 are positioned such that when the cover 700 is inserted into the housing 110, the base portion 710 rests on the tabs 725. When the base portion 710 rests on the tabs 725, the top surface of the base portion 710 lies flush with the top edges of the side walls 130. The top edges of the side walls 130 contain a locking mechanism for locking the cover 700 in place. As shown in FIGS. 6-7, a plurality of locking tabs 750 can be provided along the top edges of the side walls 130. Preferably, there are at least two locking tabs 750 located along top edges of opposite side walls 130 and in the illustrated embodiment, there are four locking tabs 750 one along each side wall 130.

Each locking tab 750 moves between a locked position and an unlocked position. The locking tab 750 pivots between these two positions. For example, the locking tab 750 can pivot about a pivot 751 (e.g., a fastener) between these two positions. FIG. 7 shoes the locking tabs 750 in the unlocked positions in which the locking tabs 750 protrude outwardly from and beyond the outer surface of the side walls 130 so as to not interfere with access to the hollow interior 112. In other words, in the unlocked positions, the base portion 710 of the cover 700 can be freely inserted between the four side walls 130 and into a position in which the base portion 710 rests on the tabs 725. As previously mentioned, in this position, the top surface of the base portion 710 lies flush with or is slightly below the top edges of the side walls 130, thereby permitting the locking tabs 750 to pivot from the unlocked positions to the locked positions in which the tabs 750 lie above the top surface of the base portion 710 so as to capture the base portion 710 between the tabs 725 and the tabs 750.

In the illustrated embodiment, there are four tabs 725 that pivot into the locked positions to secure the four sides of the cover 700 to the housing 110. To reverse the process, the user simply rotates the four tabs 725 into the unlocked position to allow for the cover 700 to be freely removed.

Figure 8:
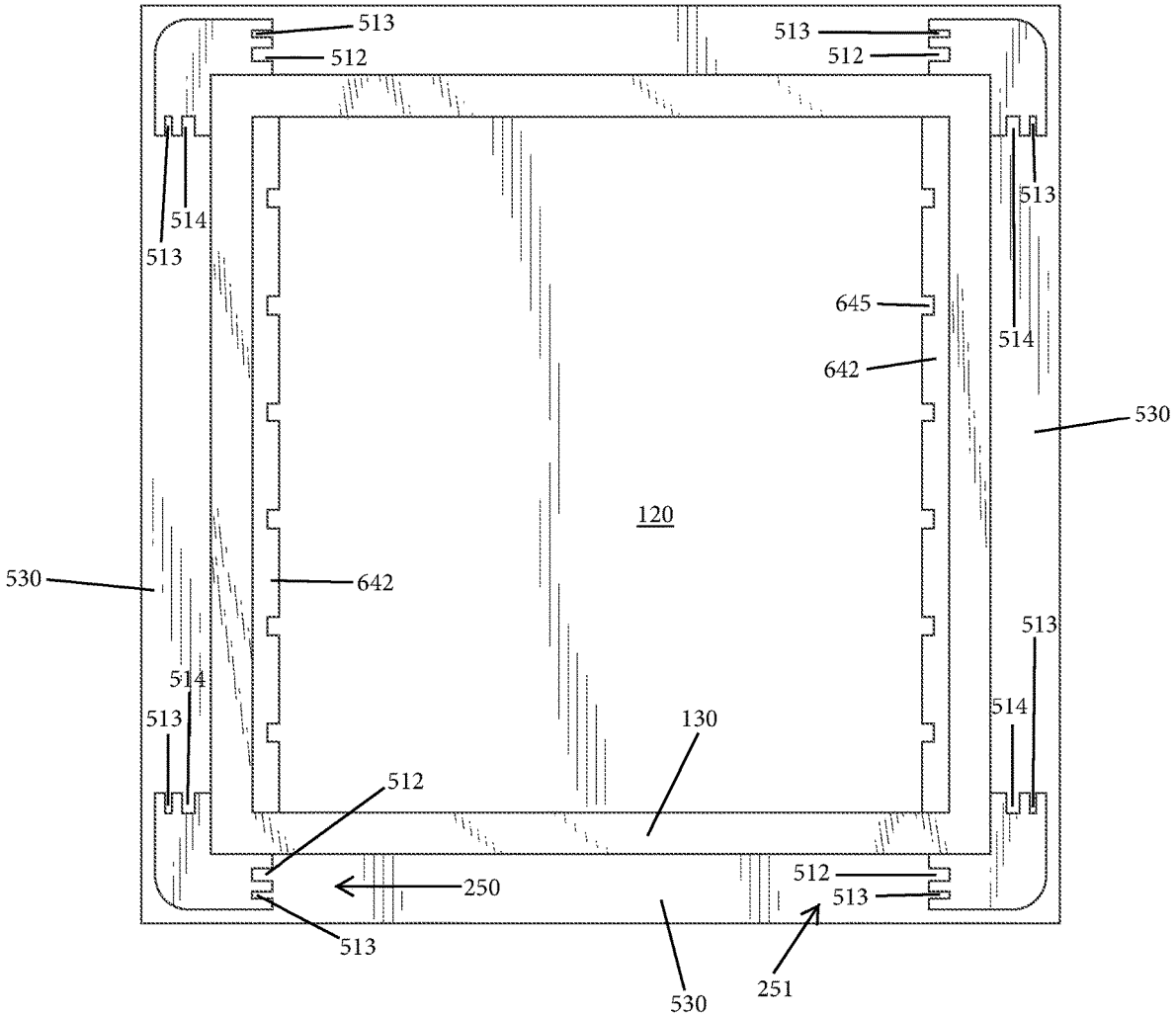
FIG. 8 is a top plan view of an apparatus according to another embodiment.

FIG. 8 shows yet another feature of the present invention in that each corner frame piece 510 can include a second notch 513 that is formed outward relative to the first notch 512 and second notch 514. As with the notches 512, 514, one pair of second notches 513 along one side wall define another exterior slot 251 that is disposed outward relative to the exterior slot 250. This exterior slot 251 can be the same or a different size relative to the exterior slot 250. In the illustrated embodiment, the exterior slot 251 is smaller than the exterior slot 250. The outwardly located exterior slot 251 is configured to receive a protective member that is disposed over the autograph tile 300. For example, a clear transparent plastic sheet can be received in the exterior slot 251 to effectively cover the autograph tile 300 and in particular, cover the autograph written thereon.

It will be appreciated that the plastic sheet can include decorative indicia along the margins thereof or in other locations. Such decorative indicia can be similar to the decorative indicia 400 used on the front structure 320 of the autograph tile 300. Thus, it can represent a certain theme, such as sports, or an event or a scene, e.g., an ocean scene or golf course hole, etc.

The housing 110 and the structures that are formed as a part thereof, e.g., the dividers 142, can be formed of any number of different materials, including but not limited to woods, plastics, glass, and any other suitable materials.

In addition, the autograph tile 300 can also include a label or the like or have a dedicated region defined thereon to allow the user to write identification information. For example, the user can neatly print the name of the person who signed to the front structure 320 and also place additional information, such as a date and/or an event description, e.g., U.S. Open Finals 2015. The label or dedicated region can be either on the front surface of the autograph tile 300 and thus be visible with the autograph or can be on the rear surface.

FIG. 12 shows that an accessory, such as a pen, can be attached to the housing 110 along one of the corner frame pieces 510. For example, a fastener 505, such as a piece of hook and loop material, can be provided along an outer surface of the corner frame piece 510. The accessory includes a complementary fastener (e.g., hook and loop material) to allow the accessory to be releasably attached and hung along the corner frame piece 510. In this way, the accessory is always readily available for use in writing an autograph on the autograph tile 300 without having to remove the cover of the housing 110.

In yet another embodiment, the apparatus 100 can include lighting placed in one or more locations so as to illuminate an autograph written on the tile 300. For example, in FIGS. 1 and 13, lighting 800 is provided along the exterior frame assembly 500 for illuminating the autograph tile 300 that is disposed with the exterior slot 250. The lighting 800 can come in any number of different forms so long as it is suitable for use in the present invention. For example, the lighting 800 can be in the form of a series of mini LEDs that are disposed along the corner frame pieces 510 and also may be provided along the floor 530 that is provided between the corner frame pieces 510. The LEDs can be formed in a dedicated track formed in the corner frame piece 510 or can be inserted through a series of openings in the corner frame piece 510 or can be attached to the corner frame piece 510 using conventional techniques, including the use of fasteners (e.g., tacks) or bonding agents, such as adhesives. The wires associated with the LEDs can be routed along the corner frame piece and/or the housing and be connected to a power supply such as a battery.

Figure 3:
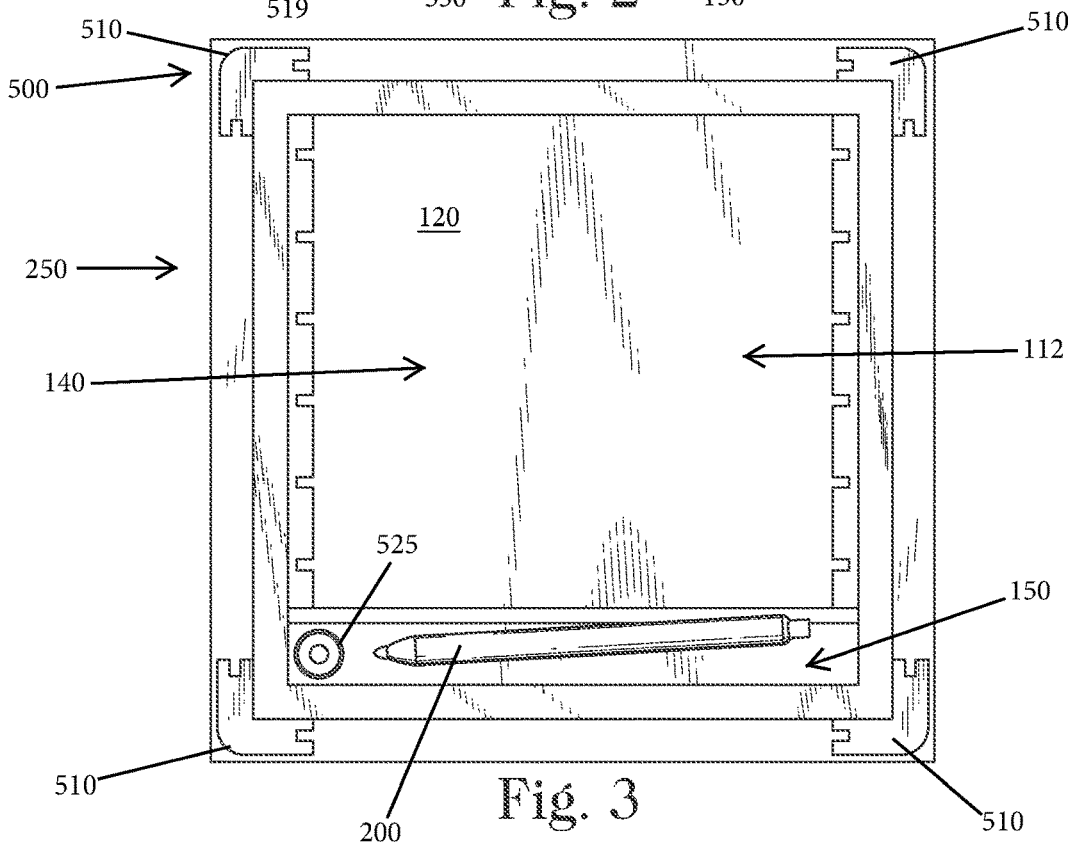
FIG. 3 is another top plan view of the apparatus of FIG. 1A showing an accessory.

A power source 525 and controller are operatively connected to the LEDs 800 to allow operation thereof. FIGS. 2 and 3 illustrate that the power source 525 can be in the form of a battery 525 disposed along the floor 130. It will be appreciated that the battery 525 can be covered with a protective layer, such as a film or sticker or a dedicated battery compartment cover that can be opened to access the battery 525. The controller is operatively connected to the power source 525 to permit controlled operation of the LEDs 800. The controller can be in the form of a user accessible switch or button that moves between ON and OFF positions. The controller can be located in any number of different locations including within the hollow interior 112 and can be located proximate the power source 525.

The LEDs 800 thus illuminate the areas around the autograph.

Figure 13:
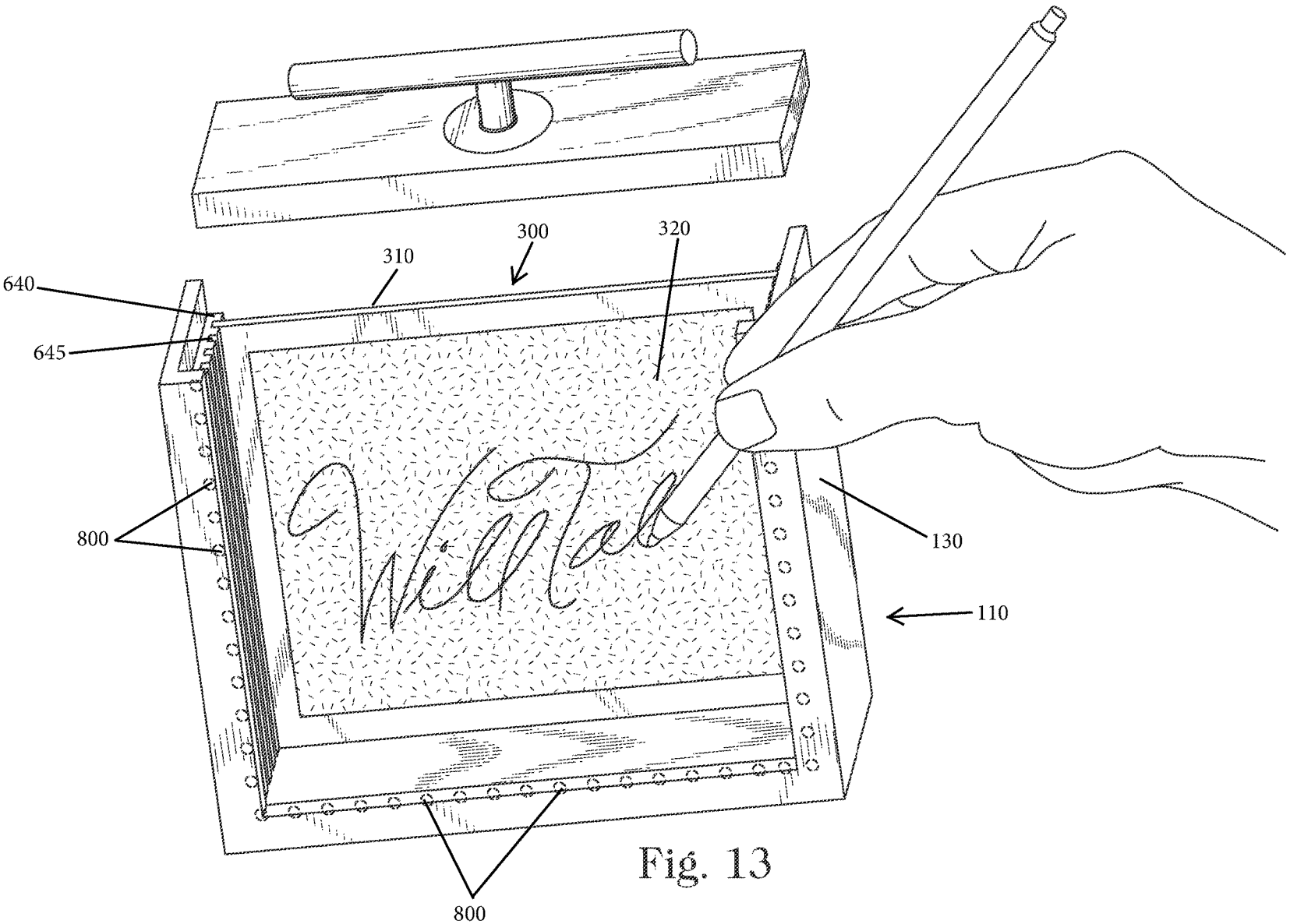
FIG. 13 is a perspective view of an apparatus for collecting and storing autographs in accordance with one embodiment of the present invention.

In yet another aspect an apparatus according to the teachings of the present invention can be as a means for holding autographs tiles 300 that are signed by members of a group, such as players on a team, or members of a band, etc., as part of memorabilia item that can later sold or be used to raise money, e.g., be part of a charity auction. In other words, the apparatuses disclosed herein can be filled with blank autograph tiles and then members of the group (e.g., team or band) can removed and sign the autograph tiles and once all of the tiles are signed, the apparatus can then be safeguarded and subsequently either sold as a collector's item or auctioned as a charity item or otherwise disposed of. FIG. 13 shows an apparatus that can provide such functionality.

Thus, the apparatus 100 is provided in a fun, attractive format and thus, can be attractively displayed after the autographs are obtained.

As mentioned, any number of different materials can be used to form the parts of the apparatus 100 of the present invention. In addition, the apparatus 100 can come in any number of different sizes so long as the autograph tile 300 includes sufficient space to allow a person to sign his or her name. The apparatus 100 is intended to be a hand-held unit that can be easy transported around events and easily given to or held onto to allow an autograph to be written thereon.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. An apparatus for collecting and storing autographs comprising:

a plurality of autograph media each of which is configured to receive an autograph;

a housing having a hollow interior that is configured to receive and hold the plurality of autograph media, the housing including a plurality of side walls and a floor; and an outer frame disposed about an outer surface of one side wall and defining an exterior slot that is open along one side for receiving autograph medium;

wherein each of the plurality of autograph media comprises a substrate to which a layer of tennis ball felt covering is attached to provide an exposed surface on which an autograph can be written.

2. The apparatus of claim 1, wherein the layer of tennis ball felt covering occupies less than an entire front surface of the substrate such that the front surface of the substrate extends around a periphery of the tennis ball felt covering.

3. The apparatus of claim 1, further including a rubber backing layer that is adhered to a rear surface of the layer of the tennis ball felt covering and to a front surface of the substrate for emulating a look and feel of a tennis ball.

4. The apparatus of claim 1, wherein the substrate is formed of wood.

5. The apparatus of claim 1, wherein the housing comprises a cube.

6. The apparatus of claim 1, wherein the housing includes a plurality of dividers disposed along inner surfaces of two opposing side walls, the dividers defining individual slots for receiving individual autograph media.

7. The apparatus of claim 6, wherein each divider comprises a body that is disposed adjacent an inner surface of one of the plurality of side walls and has the individual slots formed therein.

8. The apparatus of claim 2, wherein the outer frame is disposed about the outer surface of each side wall of the housing, each being displayed such that the layer of tennis ball felt covering faces outwardly from the housing.

9. The apparatus of claim 8, wherein the plurality of autograph media are arranged along each side of the housing.

10. An apparatus for collecting and storing autographs comprising:

a plurality of autograph media each of which is configured to receive an autograph;

a housing having a hollow interior that is configured to receive and hold the plurality of autograph media, the housing including a plurality of side walls and a floor; and an outer frame disposed about an outer surface of each side wall and defining along each side wall of the housing an exterior slot that is open along one side for receiving autograph medium;

wherein each of the plurality of autograph media comprises a wood substrate to which a tennis ball material in flattened state is attached, the tennis ball material comprising a rubber backing layer that is adhered to a front surface of the substrate and a layer of tennis ball felt covering that is attached along a rear surface to the rubber backing layer, the layer of tennis ball felt covering having a front surface which provides an exposed surface on which an autograph can be written.

11. The apparatus of claim 10, wherein the housing comprises a cube.

12. The apparatus of claim 1, wherein the layer of tennis ball felt covering occupies less than an entire front surface of the substrate such that the front surface of the substrate extends around a periphery of the tennis ball felt covering.

* * * * *